US006119600A

United States Patent [19]

Burri

[11] Patent Number: 6,119,600

[45] **Date of Patent: *Sep. 19, 2000**

[54] PROJECTILE AND METHOD FOR PRODUCING IT

[75] Inventor: Jakob Burri, Regensdorf, Switzerland

[73] Assignee: Oerlikon Contraves Pyrotec AG, Zurich, Switzerland

[ * ] Notice: This patent is subject to a terminal disclaimer.

[21] Appl. No.: 09/005,850

[22] Filed: Jan. 12, 1998

[30] Foreign Application Priority Data

Jan. 14, 1997 [CH] Switzerland ..... 0061/97

[51] Int. Cl.[7] ..... F42B 12/06

[52] U.S. Cl. ..... 102/518; 102/364; 102/516; 102/517

[58] Field of Search ..... 102/364, 501, 102/514–519, 527

[56] References Cited

U.S. PATENT DOCUMENTS

| | | | |
|---|---|---|---|
| 3,795,196 | 3/1974 | Hillenbrand . | |
| 3,890,902 | 6/1975 | Travor et al. . | |
| 3,910,194 | 10/1975 | Dehm et al. | 102/527 |
| 4,108,072 | 8/1978 | Trinks et al. | 102/518 |
| 4,108,073 | 8/1978 | Davis . | |
| 4,558,646 | 12/1985 | Hoffmann et al. | 102/527 |
| 4,671,181 | 6/1987 | Romer et al. | 102/518 |
| 4,708,064 | 11/1987 | Bisping et al. | 102/517 |
| 4,920,888 | 5/1990 | Luther et al. | 102/518 |
| 5,198,616 | 3/1993 | Anderson | 102/517 |
| 5,909,003 | 6/1999 | Burri | 102/518 |

FOREIGN PATENT DOCUMENTS

| | | | |
|---|---|---|---|
| 161 367 | 11/1985 | European Pat. Off. . | |
| 088 999 B1 | 5/1987 | European Pat. Off. . | |
| 812 377 | 5/1937 | France . | |
| 831497 | 9/1938 | France | 102/517 |
| 1 242 187 | 8/1960 | France . | |
| 1 457 971 | 9/1966 | France . | |
| 2 238 137 | 7/1974 | France . | |
| 2743732 A1 | 7/1986 | Germany . | |
| 114382 | 6/1945 | Switzerland | 102/501 |
| 666 546 A5 | 7/1988 | Switzerland . | |
| 586174 | 3/1947 | United Kingdom | 102/518 |
| 887124 | 1/1962 | United Kingdom | 102/517 |

*Primary Examiner*—Harold J. Tudor
*Attorney, Agent, or Firm*—Townsend and Townsend and Crew LLP; Guy W. Chambers, Esq.

[57] ABSTRACT

By means of this method it is possible to produce projectiles with single- or multi-element projectile bodies of different shapes and sizes simply and in a time-saving way. The jacket (1) of the projectile consists of a projectile tip (3), which is fixedly connected with a projectile casing (2) and has a centering device (5, 9) in its interior, in which the projectile body (6) is guided and maintained. The projectile body (6) is essentially cylindrical or has a diameter which increases toward the rear. The back of the projectile casing (2) is closed by means of a sealing body (15), which partially extends around the projectile body (6). In the course of producing the projectile, the projectile tip (3) is injection-molded to the projectile casing (2) in a first step, and in a second step the projectile body (6) is pushed into the centering device (5, 9). In a third step the sealing body (15) is injected into the projectile casing (2), after which the projectile body (6) is completely enclosed in the injected material at the front at a shoulder (11), laterally, and at the rear.

6 Claims, 4 Drawing Sheets

PROJECTILE AND METHOD FOR PRODUCING IT

FIELD OF THE INVENTION

The invention relates to a projectile with a jacket and a projectile body, which is arranged in the jacket and maintained in place by a centering device and whose diameter from front to back is the same or increasing, and to a method for producing it.

BACKGROUND OF THE INVENTION

Such long known projectiles, for example steel jacket projectiles, have a jacket of steel and a projectile core or respectively a projectile body made of hardened lead or, with so-called tipped projectiles, a projectile core or respectively a projectile body of steel. Other projectiles, such as the hard core projectiles used for antitank operations, for example, consist of a very hard and heavy armor-piercing projectile or respectively armored core and a coat of soft steel. Projectiles are also known, whose jacket consists at least partially of a suitable plastic material.

With some of these projectiles, wherein as a rule the projectile body fills the entire jacket, variations in shape or size of the core or respectively of the projectile body of the identical caliber or respectively jacket are hardly possible. Other projectiles, by means of which it would be possible to equip identical jackets with different projectile bodies and in this way to obtain different projectiles, are comparatively expensive to produce.

For example, French patent publication FR 1 242 187 describes a projectile with a projectile body, a jacket consisting of a projectile tip and a projectile casing fastened on the exterior of the projectile tip, and a sealing body closing off the jacket at the rear and extending around the rear area of the projectile body. The diameter of the projectile body is approximately zeppelin-shaped, which means that initially it increases from the front to the back and decreases again later. It is therefore not possible to first produce the jacket and to subsequently equip it with the projectile core, which would be desirable for producing the same jackets in large series in order to subsequently produce different projectiles from them by equipping them with different projectile bodies. In particular, it is not possible to produce the projectile tip by injection molding.

A projectile is known from French patent publication FR 812 377, in connection with which it would be possible to equip the same jackets with different projectile cores, depending on the intended use. This projectile has a projectile body, centered at the front by a ring, and a jacket surrounding it, which is closed at the back by a metallic sealing body which extends around the projectile body in its rear area. The sealing body is intended above all to constitute additional mass, i.e. should be correspondingly heavy, and therefore must be made of metal. The jacket comprises the projectile tip and the projectile casing formed integrally with the projectile tip, and is also made of metal. The disadvantage of this projectile essentially lies in that its manufacture is comparatively elaborate, particularly since the jacket and the sealing body are both made of metal, so that it is not possible to produce one of the two elements or both elements by injection molding.

A further projectile with a jacket and a projectile body is known from US Patent U.S. Pat. No. 3,795,196. The jacket consists of the projectile tip at the front, while the rear area of the jacket is formed by the sealing body which is simultaneously used for closing the jacket off at the rear.

This sealing body is made of metal. This projectile does not have a projectile casing. Two centering rings are provided for centering the projectile core. The shaping would theoretically allow the equipping of the same type of jacket with different projectile bodies. But it would then be necessary to introduce the projectile bodies from the front into the jacket. But because of the structure having centering rings, injection molding of the projectile tip and thus a cost-effective manufacture would not be possible.

Finally, a projectile is known from French patent publication FR 2 238 137, whose projectile core is conical in its front half and cylindrical in its rear half. This projectile core is enclosed in a jacket. In principle, the shaping would permit the equipping of jackets of the same type with different projectile bodies from the rear and in this way the production of different projectiles. The jacket of this projectile is formed by a projectile tip made of an injectable material, more accurately of plastic, which is injection-molded on the metallic projectile casing. The rear opening of the jacket is closed by a closure or sealing body, which projects into the jacket and partially encloses the projectile core. In the front portion of the projectile, the outer surface of the jacket is constituted by the projectile tip, and in the rear portion of the projectile by the metallic sealing body.

In this respect the projectile is embodied the same as that of US Patent U.S. Pat. No. 3,795,196 but has, in contrast to the projectile of the said US Patent U.S. Pat. No. 3,795,196, a projectile casing. The projectile casing, which rests against the projectile body in its central area, does not lie against the outer surface of the jacket, but is only used to form an indirect screw connection between the projectile tip and the sealing body. A collar formed on the portion of the sealing body projecting into the jacket is mainly used as the centering device. The main disadvantage of this projectile lies in that its manufacture is elaborate for the following reason: the sealing body constitutes the rear portion of the outer surface of the jacket. Therefore a guide ring will have to be fastened on the sealing body, so that it becomes obvious to make the sealing body of metal. This has as a result that the centering arrangement which must have precise dimensions, must also be made of metal, all of which is connected with a comparatively large outlay.

In summary it must be said that none of the known projectiles meet the requirements mentioned above regarding the use of different projectile bodies, on the one hand, and simple manufacture, on the other.

OBJECT AND SUMMARY OF THE INVENTION

It is therefore the object of the invention to propose, based on the prior art in accordance with French patent publication FR 2 238 137, a projectile of the type mentioned at the outset, as well as a process for producing it, wherein the jacket can be equipped with projectile bodies of different types in accordance with the respective purpose, and which can be produced in a simple and therefore cost-effective manner.

With the novel projectile, the projectile body is embodied in such a way that its diameter from the front to the back is constant or increasing, but not decreasing, so that the projectile core can be introduced from the rear into the prefabricated jacket. The jacket consists of a generally metallic projectile casing and a projectile tip of an injectable cured material, preferably of plastic, which is injection-molded to the projectile casing. A recess for the projectile core and a centering arrangement for guiding and fixing the projectile body in place are provided in the interior of the projectile tip. Thus the centering arrangement of the novel projectile is provided on an injection-molded component, i.e. the projectile tip, so that the high cost of producing the centering arrangement on a metallic component are avoided. The outer surface of the jacket, which in the front part of the projectile is constituted by the projectile tip, is constituted by the metallic projectile casing in the rear part of the projectile, which in this way can be used as a solid fastening basis for fastening the guide ring. The rear opening of the jacket, the rim of which is constituted by the projectile casing, is closed by means of a sealing body, which extends into the interior of the jacket and in the process extends partially around the projectile core.

Since the guide ring need not be fastened on the sealing body, preferably not only the projectile tip, but also the sealing body is made of plastic and is generally injection-molded after equipping the jacket, so that manufacturing and assembling are performed in one work step. A particularly advantageous projectile is obtained with an injection-molded sealing body, since by means of it the projectile body is completely fixed in place in the axial direction without it being necessary, for example, to perform a highly precise mechanical production, or respectively also in cases in which the projectile core has been produced within comparatively large permissible variations.

In the course of producing the projectile, the projectile tip is injection-molded onto the projectile casing in a first step, and the projectile body is pushed into the centering device from behind until reaching a detent in a second step. The sealing body is applied in a third step. The latter is preferably produced by means of the introduction of an injectable material into the interior of the projectile casing or respectively the jacket, after which the projectile body is completely surrounded in the front at the detent, laterally on its circumferential surface and in the rear at its end surface, by the injected material of the projectile tip and the sealing body.

The advantages attained by means of the invention are to be seen in that it is possible to use single- or multi-element projectile bodies of various types and sizes in the same jacket, wherein furthermore the proposed fabricating process is simple and time-saving, since in contrast to the projectile of French patent publication FR 2 238 137 not only the projectile tip per se, but also the centering device is made of an injectable material, so that advantageous manufacturing costs can be achieved. If the sealing body is also made of an injectable material, which is easily possible and is even recommended, the manufacturing costs are further reduced.

The invention will be explained in more detail in what follows by means of two exemplary embodiments in connection with the drawings.

DETAILED DESCRIPTION OF THE PREFERRED EMBODIMENTS

Figure 2:
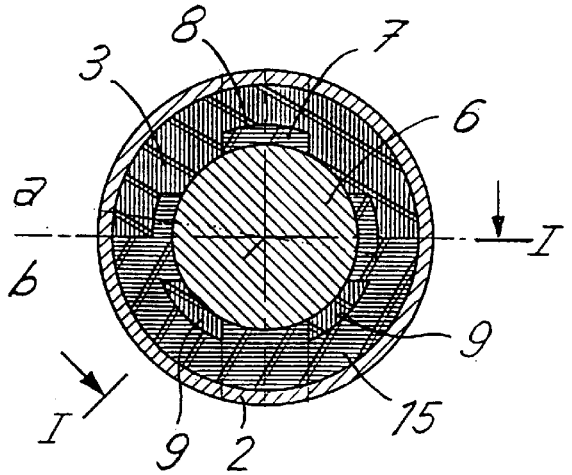
FIG. 2 represents two semi-cross sections a, b through the projectile along the lines II—II and II'—II' in FIG. 1.
Figure 1:
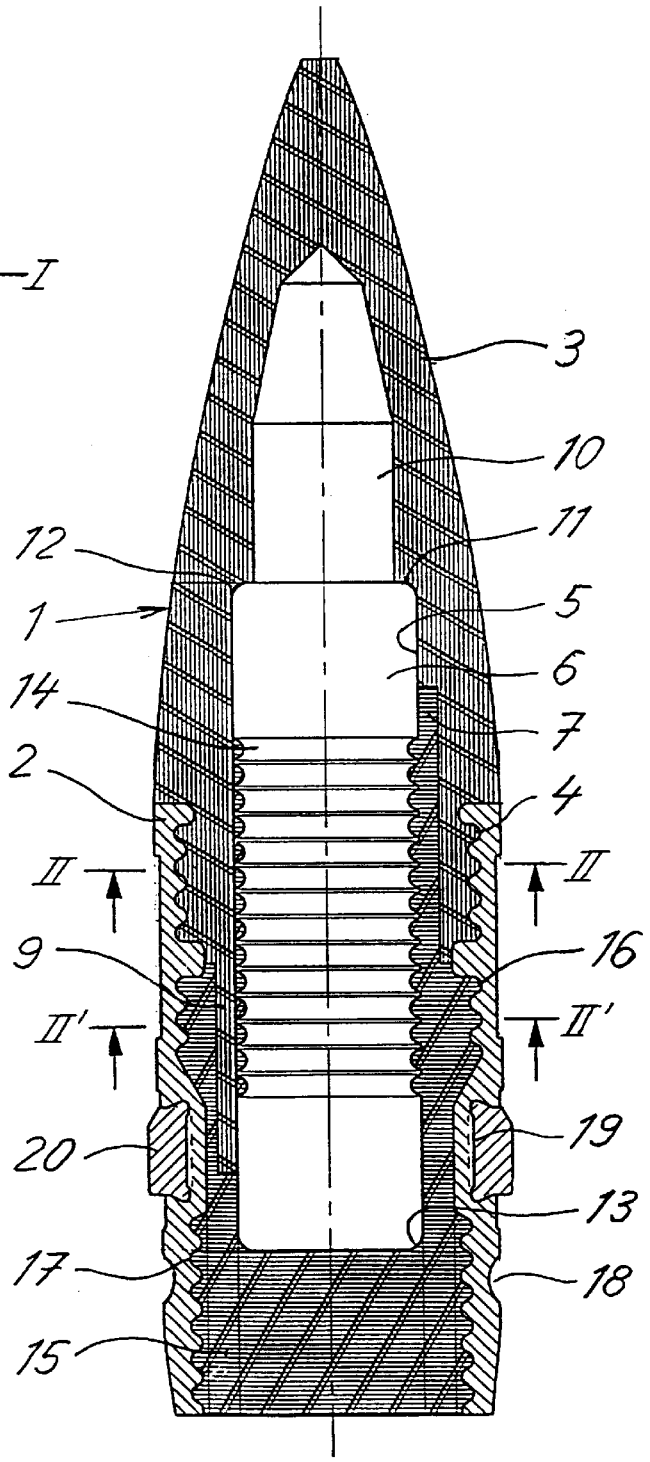
FIG. 1 represents a longitudinal section along the line I—I in FIG. 2 through the projectile in accordance with the invention in a first embodiment.
Figure 4:
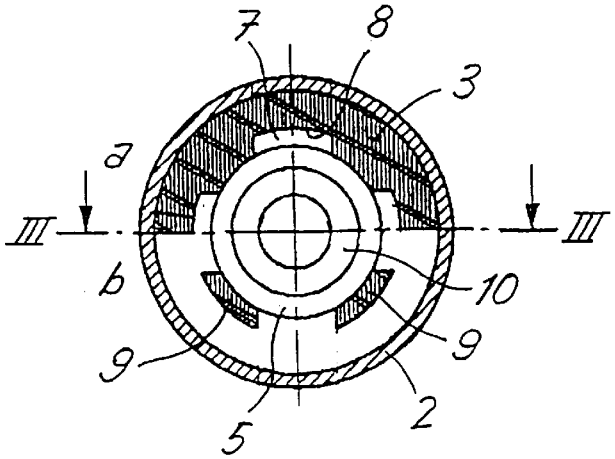
Figure 3:
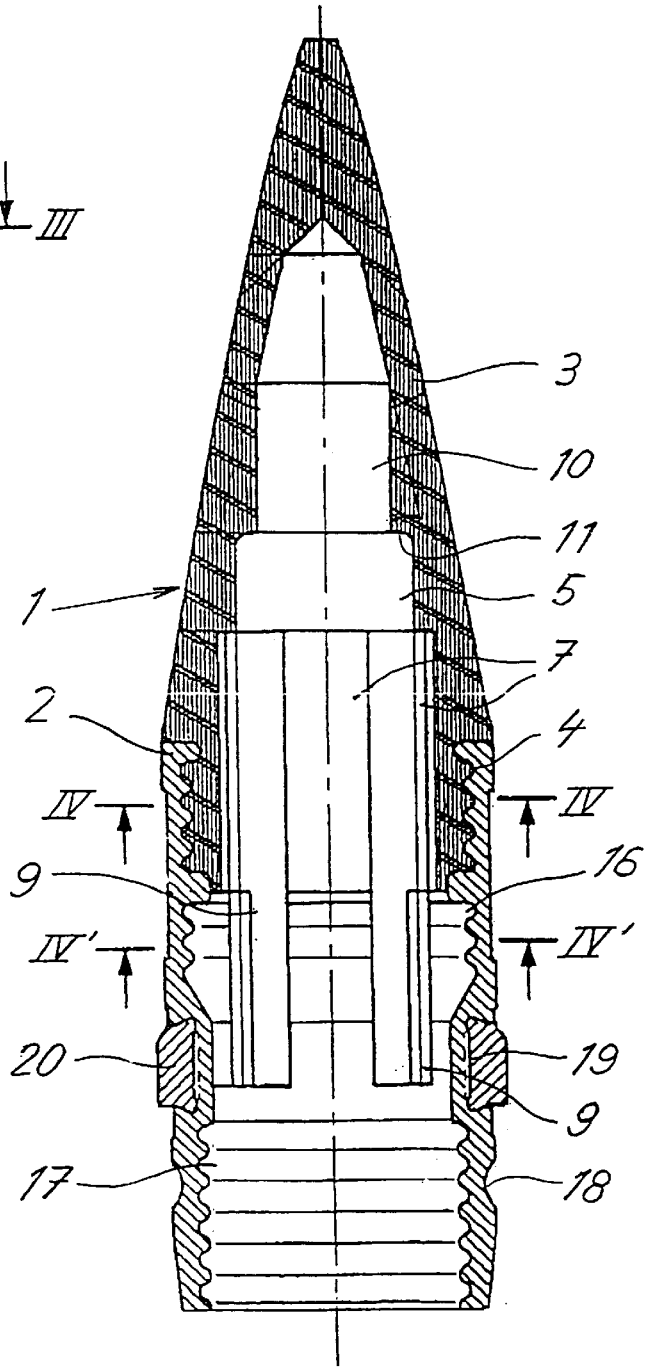
FIG. 3 represents a longitudinal section through the projectile along the line III—III in FIG. 4 following a first method step, FIG. 4 represnts two semi-cross sections a, b through the projectile along the lines IV—IV and IV'—IV' in FIG. 3.

FIGS. 1 to 4 represent a projectile with a jacket 1, which is formed by a projectile casing 2 and a projectile tip 3 fixedly connected therewith. In a first step of a fabricating process, the projectile tip 3, which consists of an injected material, preferably of a highly heat-resistant, fiber-reinforced thermoplastic material, is injection-molded to the projectile casing 2, wherein it penetrates projectile casing grooves 4 arranged in the interior of the projectile casing 2 and is anchored in this way. The projectile tip 3 has a cylindrical recess 5, which is coaxial in respect to the longitudinal projectile axis, for receiving and centering a projectile body 6. Four channels 7, offset by 90°, are provided in the recess 5, whose bottom surface 8 is concentrically arched in the form of a partial circle in respect to the recess 5. Four strips 9 are arranged on the rim of the recess 5 on the back of the projectile tip 3 and are offset by 90° in respect to the channels 7, and are at a distance from each other which corresponds to the width of the channels 7. In cross section, the strips 9 are arcuate and have a thickness corresponding to the depth of the channels 7. The recess 5 is continued in the direction toward the projectile tip in a cylindrical recess extension 10, which also extends coaxially in respect to the longitudinal axis of the projectile and has a lesser diameter than the recess 5 and, together with the recess 5, constitutes a shoulder, which is intended to form an axial detent 11 for the projectile core.

In accordance with the first exemplary embodiment, the projectile body 6, which at times is also identified as the projectile core or penetrator, has a cylindrical shape with projectile body edges 12, 13, rounded at the ends. The projectile body 6 has practically the same diameter as the recess 5 and on its exterior is provided with circumferential projectile body grooves 14. In a second step of the fabricating process, the projectile body 6 is pushed through the projectile casing 2, represented in FIG. 3, which is still open at the back, along the strips 9 into the recess 5 until it is in contact with the detent 11 at the shoulder provided for this, and is maintained centered in this position.

A sealing body 15, consisting of the same injectable material as the projectile tip 3, i.e. preferably of thermoplastic material, is formed in a third fabricating step by injecting the injectable material into the projectile casing 2, still open at the back. In the process, the injectable material also penetrates into the channels 7 and between the strips 9 of the projectile tip 3, as well as into the projectile body grooves 14 of the projectile body 6. Thereafter, the projectile body 6 is completely enclosed in the injectable or respectively injected material at the front at the shoulder constituting the detent 11, laterally, and in the back, and is firmly anchored in the jacket 1. The injectable material furthermore also penetrates into further projectile casing grooves 16, provided on the inside of the projectile casing 2, and into rear projectile casing grooves 17, by means of which the sealing body 15 is firmly anchored in the projectile casing 2, as can be seen from FIGS. 1 and 2.

In a manner known per se, a circumferential casing channel 18 for fastening a cartridge casing, not represented, and a circumferential ring channel 19 are provided in the rear area of the projectile casing 2, wherein a guide ring 20 is disposed in the circumferential ring channel for guiding the projectile in a weapons tube.

Figure 5:
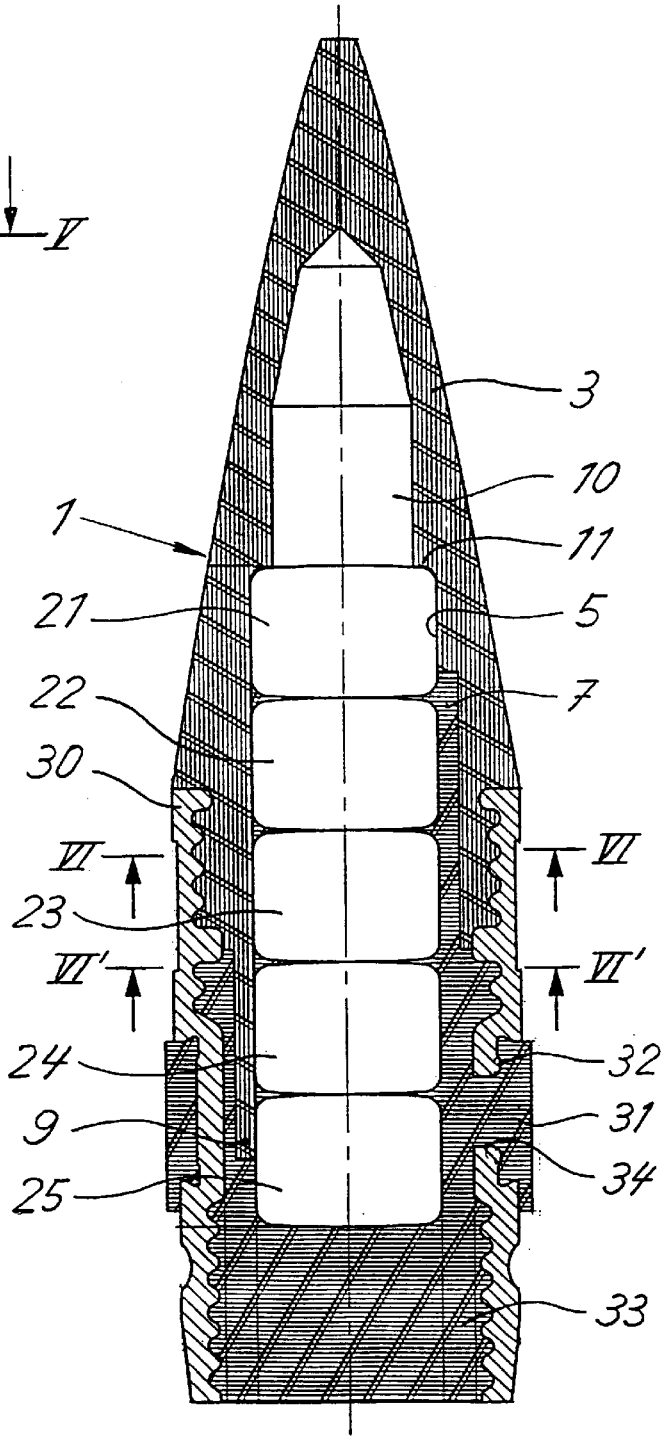
FIG. 5 represents a longitudinal section through the projectile in a second embodiment along the line V—V in FIG. 6.

In accordance with FIG. 5, the projectile body of the second embodiment consists of several partial projectile bodies 21 to 25. As shown by way of an example, the partial projectile bodies 21 to 25 can consist of cylinder-shaped pellets which are lined up in the longitudinal projectile direction, the same as previously described by means of FIG. 1, and in the second fabricating step are inserted into the centering device formed by the recess 5 and the strips 9, and which are enclosed in the injectable material and firmly anchored in the course of the formation of the sealing body 33 in the third step of the fabricating process. However, it is also possible to use partial projectile elements of a different shape and number. The type or respectively the material of the partial projectile elements can also be different in general or within a projectile. For example, it is possible to use a frangible heavy metal for the partial projectile bodies 21 and 24, a ductile heavy metal for the partial projectile bodies 22 and 25 and an incendiary composition for the partial projectile body 23.

In accordance with FIG. 5, a guide ring 31 is embedded in a circumferential channel 32 of a projectile casing 30. In the third step of the fabricating process, the guide ring 31 is formed integrally with the sealing body 33 by injecting the highly heat-resistant fiber-reinforced thermoplastic material into the projectile casing 30 open at the back. Several radial recess 34 are provided in the circumferential channel 32 for the exit of the injectable material into the latter from the projectile casing 30. The fabricating costs of the projectile can be lowered and the wear occurring in the weapons tube during firing can be reduced by means of a guide ring 31 manufactured and fastened in this way.

Figure 6:
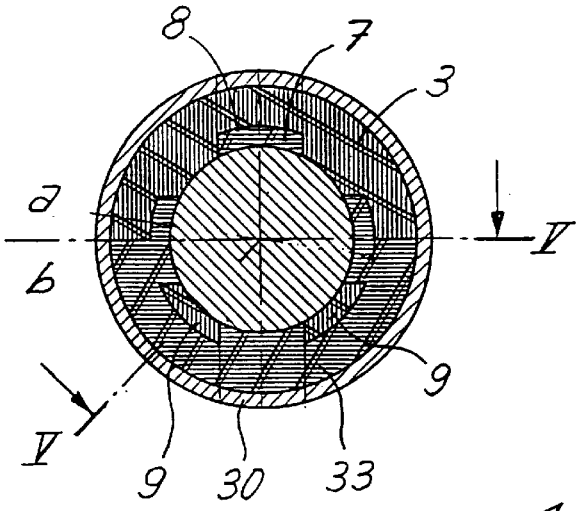
FIG. 6 represents two semi-cross sections a, b through the projectile along the lines VI—VI and VI'—VI' in FIG. 5.

Two semi-cross sections a, b through the projectile along the lines VI—VI and VI'—VI' in FIG. 5 are represented in FIG. 6.

Figure 7:
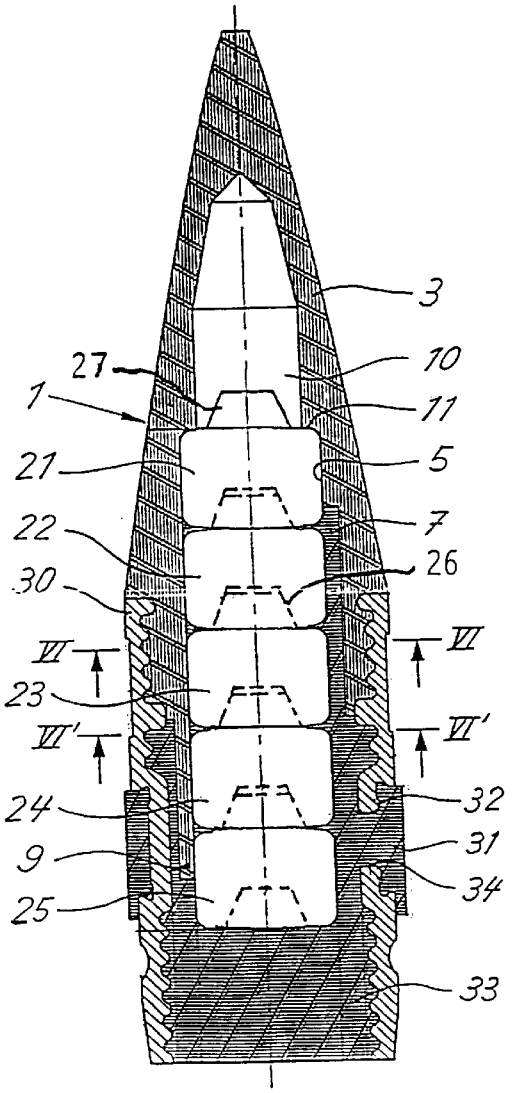
FIG. 7 represents a longitudinal section through the projectile in a variant of the second embodiment along the line V—V in FIG. 6.

FIG. 7 represents a variant of the form of the partial projectile bodies 21 to 25 represented in FIG. 5. For even more exact centering, the individual partial projectile bodies 21 to 25 have in this case, on the one hand, peg-shaped extensions 27 on the front faces, and the end faces have corresponding depressions 26, into which the peg-shaped extensions project. These extensions 27 and also the corresponding depressions 26 can be simply manufactured and permit a simple assembly with perfect mutual centering. This centering is all the more important, the better the projectiles need to be balanced.

Figure 8:
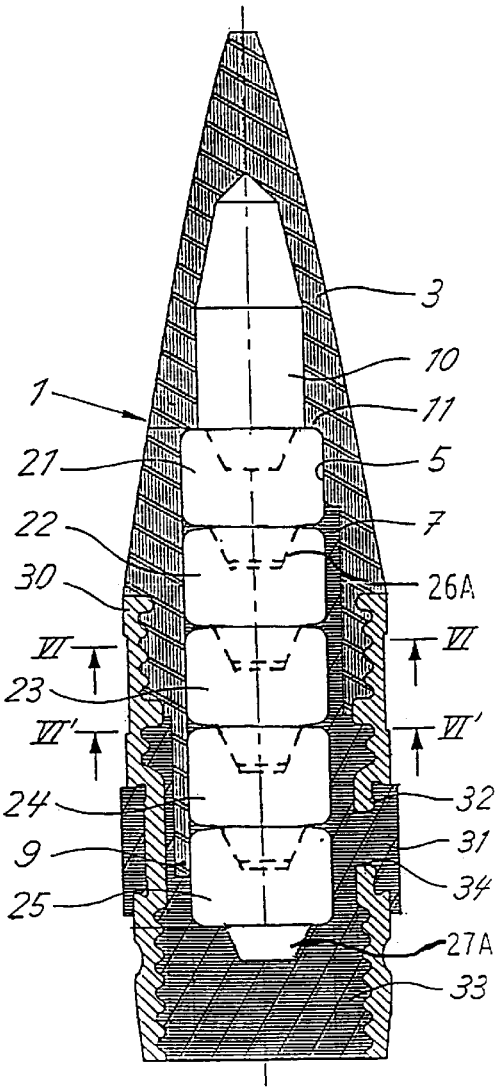
FIG. 8 represents a longitudinal section through the projectile in a further variant of second embodiment along the line V—V in FIG. 6.

FIG. 8 shows a further variant of the shape of the partial projectile bodies 21 to 25 represented in FIG. 5. Here, peg-like extensions 27A are provided on the end faces of the pellet-shaped partial projectile bodies 21 to 25, which engage depressions 26A provided in the front faces of the succeeding partial projectile bodies.

What is claimed is:

1. A projectile comprising:

a jacket;

a projectile body; and, a plastic injection molded rear sealing body;

wherein said jacket further comprises a plastic projectile tip which is injection molded onto a metal projectile casing so that said projectile tip extends forward from the front end of said casing and said projectile tip includes an interior recess to act as a centering device for said projectile body;

further wherein said projectile body comprises a plurality of partial projectile bodies which are inserted into axial alignment within said jacket with the assistance of said projectile tip recess and are fixed in place by injection molding said rear sealing body into a rear portion of said casing.

2. The projectile in accordance with claim 1 wherein the partial projectile bodies consist of different materials.

3. The projectile in accordance with claim 1, wherein at least one of the partial projectile bodies is selected from the group consisting of ductile metal, frangible metal and an incendiary composition.

4. The projectile in accordance with claim 1, wherein the partial projectile bodies have recesses and peg extensions for mutual centering.

5. The projectile in accordance with claim 1 wherein said projectile tip recess further includes longitudinal channels.

6. The projectile in accordance with claim 1 wherein the projectile tip and the rear sealing body are formed of a heat-resistant, fiber-reinforced thermoplastic material.

* * * * *